US008328016B2

(12) United States Patent
Thornton et al.

(10) Patent No.: US 8,328,016 B2
(45) Date of Patent: Dec. 11, 2012

(54) DISPLAY PACKAGE

(75) Inventors: Kelley Thornton, Chicago, IL (US); Steven Gold, Chicago, IL (US); Richard Egresitz, West Deptford, NJ (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 12/872,062

(22) Filed: Aug. 31, 2010

(65) Prior Publication Data

US 2011/0278192 A1 Nov. 17, 2011

Related U.S. Application Data

(60) Provisional application No. 61/240,000, filed on Sep. 4, 2009.

(51) Int. Cl.
*B65D 73/00* (2006.01)

(52) U.S. Cl. ..... 206/465; 206/468

(58) Field of Classification Search ..... 206/464, 206/465, 471, 467, 469, 468, 461, 5.1
See application file for complete search history.

(56) References Cited

U.S. PATENT DOCUMENTS

| | | | | | |
|---|---|---|---|---|---|
| 2,850,160 | A * | 9/1958 | Siebel et al. | ..... | 206/464 |
| 3,104,759 | A * | 9/1963 | Hansen | ..... | 206/465 |
| 3,157,280 | A * | 11/1964 | Perdue et al. | ..... | 206/468 |
| 3,326,371 | A * | 6/1967 | Riestenberg | ..... | 206/465 |
| 3,382,972 | A * | 5/1968 | Phipps | ..... | 206/468 |
| 3,464,544 | A * | 9/1969 | Franck | ..... | 206/468 |
| 3,467,248 | A * | 9/1969 | Makowicki | ..... | 206/465 |
| 3,685,648 | A * | 8/1972 | Heller | ..... | 206/462 |
| 4,133,429 | A * | 1/1979 | Kuchenbecker | ..... | 206/465 |
| 4,574,951 | A * | 3/1986 | Weaver | ..... | 206/461 |
| 4,781,294 | A * | 11/1988 | Croce | ..... | 206/469 |
| 5,344,018 | A * | 9/1994 | Severin | ..... | 206/469 |
| 5,377,836 | A | 1/1995 | Eisenbraun | | |
| 5,579,910 | A * | 12/1996 | Bennett | ..... | 206/362 |
| 5,586,657 | A | 12/1996 | Ward et al. | | |
| 5,730,291 | A * | 3/1998 | Smallwood | ..... | 206/455 |
| 5,944,177 | A * | 8/1999 | Nemoto | ..... | 206/232 |
| 6,543,209 | B1 * | 4/2003 | Siegel et al. | ..... | 53/492 |
| 8,104,616 | B2 * | 1/2012 | Dalea et al. | ..... | 206/427 |
| 2001/0007308 | A1 * | 7/2001 | Glassman | ..... | 206/469 |
| 2005/0092644 | A1 * | 5/2005 | Cafferata et al. | ..... | 206/471 |
| 2005/0098467 | A1 * | 5/2005 | Agakanian | ..... | 206/471 |

* cited by examiner

*Primary Examiner* — Jacob K Ackun
(74) *Attorney, Agent, or Firm* — Matthew M. Eslami

(57) ABSTRACT

A theft deterrent display package for at least one article comprises a product cradle having an interior space with a perimeter. A peripheral flange extends outwardly from the perimeter of the interior space. A locking slot is configured along the perimeter of the interior space. At least one self-standing leg extends downwardly from the interior space upon which the display package stands alone. A backboard is defined by a front face and a back face. A locking tab comprises a free end extends outwardly from one edge of the back face. The locking tab includes two angled fold lines used in assisting the free end of the locking tab to be inserted into the locking slot to securely enclose the display package.

13 Claims, 5 Drawing Sheets

DISPLAY PACKAGE

FIELD OF THE INVENTION

This invention relates generally to a display package, more particularly to a pilfer deterrent package, that is easily assembled and reduces the amount of plastic typically used in similar packages.

BACKGROUND OF THE INVENTION

The common practice for displaying small and lightweight retail items is to package the items in thermoformed blister packages and place the packages on shelves or hang the packages on hooks on various display racks. The conventional blister package is composed of a generally stiff supportive backing usually made of a cardboard or a display card, and a thermoformed polymeric blister that is heat sealed to the display card. The display card for this purpose is coated with a layer of lacquer containing a plastic material of the type which allows the blister to be secured to the display card through welding or heat sealed. The display card provides support for displaying the merchandise for sale and contains print with suitable indicia such as advertising and instructions. One disadvantage of the prior art is that the display card and the blister are generally heat sealed or permanently glued and thus require special tooling to attach the display card to the blister. Another disadvantage of the prior art is that the display package is not easy and safe to open since the display card or the blister should be tear apart to access the product contained therein.

Accordingly, what is needed is a pilfer deterrent display package that does not require special tooling to attach the display card or backboard to the blister and is simple and inexpensive to manufacture and assemble.

SUMMARY OF THE INVENTION

One advantage of the present invention is that the backboard or display card and the product cradle are not bonded or heat sealed and thus there is no need for specialized tooling to attach the display card or backboard to the product cradle. Other advantages of the present invention are: 1) Items are easily packed without machinery 2) Self-standing 3) Separates completely for recycling 4) Theft deterrent 5) Plenty of room for graphics 6) Easier and safer to open than a plastic clamshell.

It is the purpose of the invention to provide an improved display package which shall have the backboard or display card and a product cradle or blister or the plastic member which are so firmly united with each other that they cannot get loose from each other by accident, nor shall it be possible to manipulate the package to get access to the contents without causing visible damage. The blister material shall be chosen from among any conceivable plastic material, including plastic materials which are favorable from an environmental point of view. The backboard or display card as well as any possible frame sheet shall be chosen from among any material, including paperboard or plastic which can be re-utilized. The fastening of the product cradle or blister, as the case may be, to the backboard does not require lacquering of the backboard and/or the frame sheet and welding is not required. The packaging and the manufacturing of the display package may be carried out by simple and non-expensive machine equipment.

Accordingly, one aspect of the present invention is related to a display package comprising a product cradle having an interior space to receive at least one article. The product cradle further includes a peripheral flange extends outwardly from a perimeter of the interior space and a locking slot along the perimeter of the interior space. A backboard comprises a locking tab configured to be inserted into the locking slot to securely enclose the display package. The backboard includes a front face and a back face defined by a fold line in which the front face comprises a U-shaped cut out and two prongs. The back face comprises a generally T-shaped perforations and a finger access hole formed therein. The backboard includes a plurality of grooves formed by adhesively attaching the front and back faces to one another and wherein the plurality of grooves receive the peripheral flange of the product cradle. The product cradle includes two substantially similar self-standing legs integrally formed within the product cradle and each of the self-standing legs configured on opposed side of the locking slot.

Another aspect of the present invention is related to a theft deterrent display package for at least one article comprises a product cradle having an interior space with a perimeter. A peripheral flange extends outwardly from the perimeter of the interior space. A locking slot is configured along the perimeter of the interior space. At least one self-standing leg extends downwardly from the interior space upon which the display package stands alone. A backboard is defined by a front face and a back face. A locking tab comprises a free end extends outwardly from one edge of the back face. The locking tab includes two angled fold lines used in assisting the free end of the locking tab to be inserted into the locking slot to securely enclose the display package. The backboard includes a contact adhesive with a thickness that secures the front and back faces to one another and forms the plurality of grooves between the front and back faces which have a width equal to the thickness of the contact adhesive.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
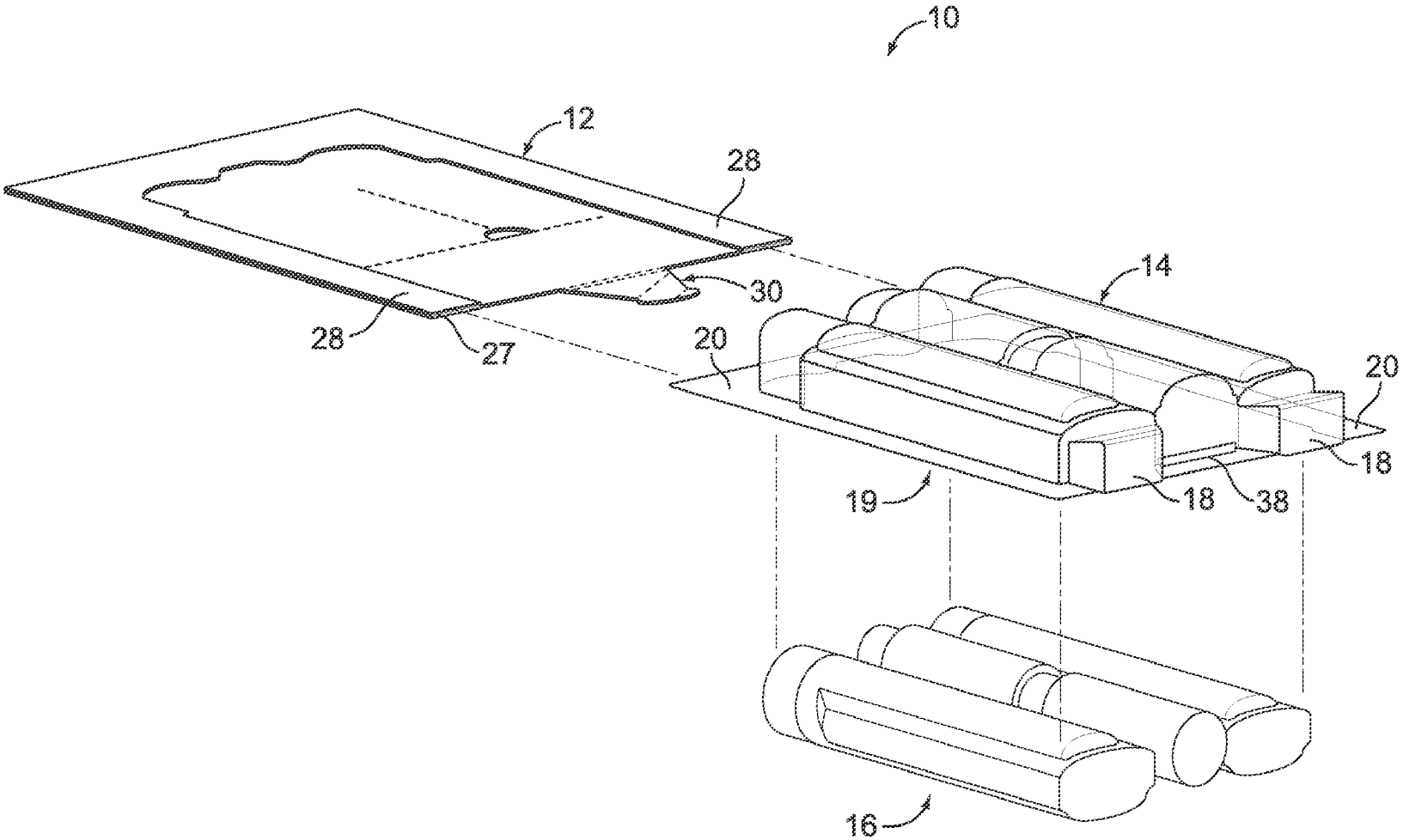
FIG. 1 is an exploded perspective view of a backboard, a vacform or a product cradle, and a plurality of articles or products used to be disposed in the product cradle which are all together form a display package in accordance with the preferred embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 is an exploded perspective view of a display package 10 having a backboard or display card 12, a product cradle or vacform 14, and a plurality of articles or products 16 in accordance with the preferred embodiment of the present invention. The display package 10 is a used to contain the plurality of articles or products of various size and shape by means of using a product cradle or vacform 14 (i.e., vacuum formed) preferably made of clear plastic and is also known as blister. The product cradle or vacform 14 includes an interior space 19 which receives the plurality of article or products 16. The perimeter and extruded shape of the interior space 19 correspond to the shape of the product. A backboard or display card 12 is attached to the product cradle or vacform 14 through a locking tab 30 that inserted into a locking slot 38 to securely lock the backboard or display card 12 to the product cradle or vacform 14. The locking tab 30 and the locking slot 38 will be discussed in greater detail hereinbelow.

Figure 2:
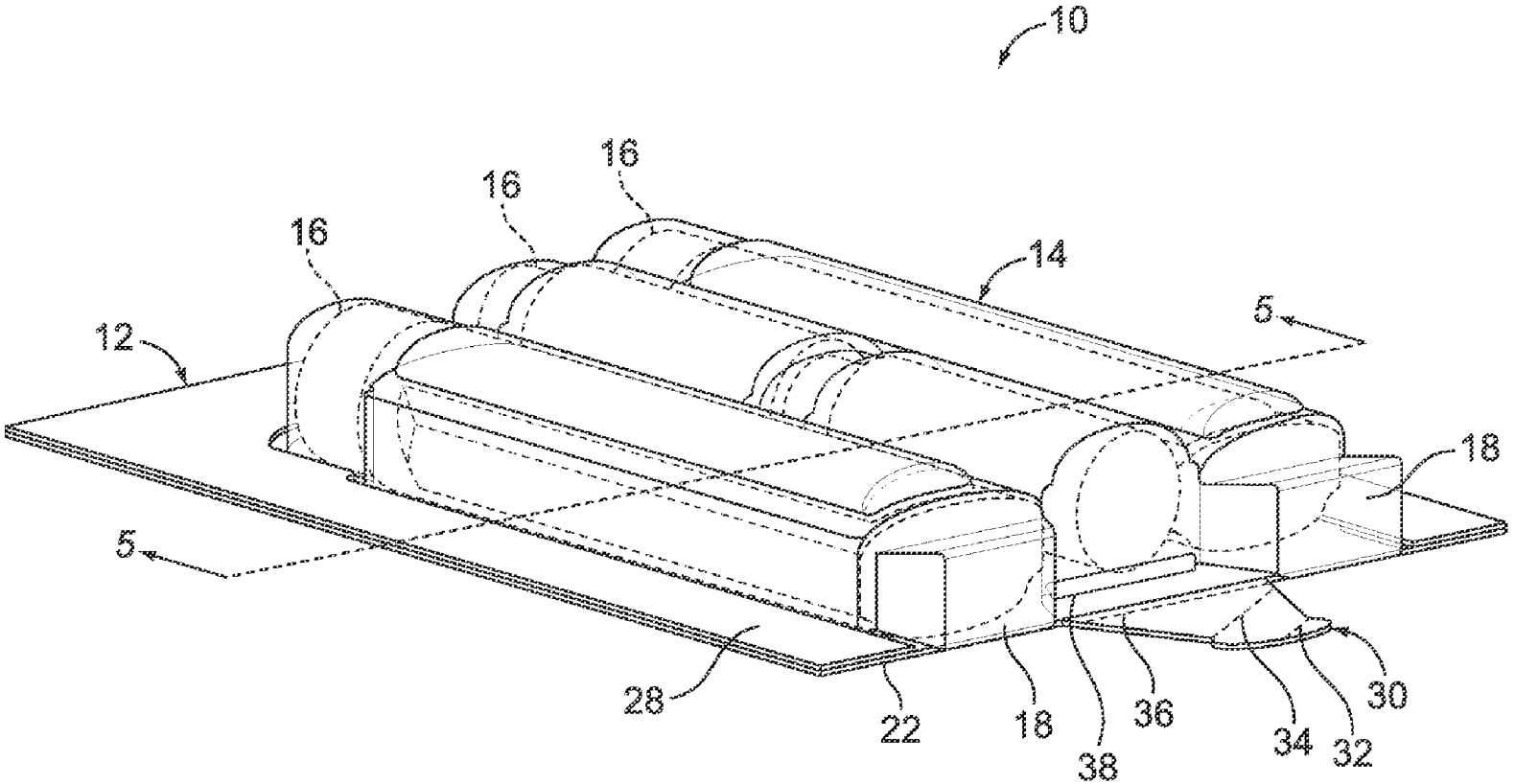
FIG. 2 is similar to FIG. 1 illustrating the display package fully constructed.

To assemble the display package 10, the article or product 16 is disposed in the interior space 19 and then the backboard or display card 12 is engaged with the product cradle or vacform 14 to securely enclose the product 16 as depicted in FIG. 2. The display package 10 includes two legs 18 (FIG. 3) that permits the display package 10 to be self-stand for displaying the products 16 in a retail store. The display package 10 eliminates the use of hooks or the like for hanging the package since it is self-standing.

The product cradle or vacform 14 is preferably made of clear plastic for full visibility of the enclosed product 16 from the front, top and sides. The product cradle or vacform 14 is molded in a manner to form two identical legs 18 and a flange 20. The flange 20 is configured on the perimeter of both side free edge of the product cradle or vacform 14. The two legs 18 extends from one end of the product cradle or vacform 14 and permits the display package 10 to stand vertically, for example, when the display package is displayed on a shelf or in a tray. The flange 20 is used to attach vacform 14 to the backboard 12 to securely hold the products in the interior space 19. In addition, the product cradle or vacform 14 includes a slot 38 formed therein that is used to engage with the locking tab 30.

Figure 3:
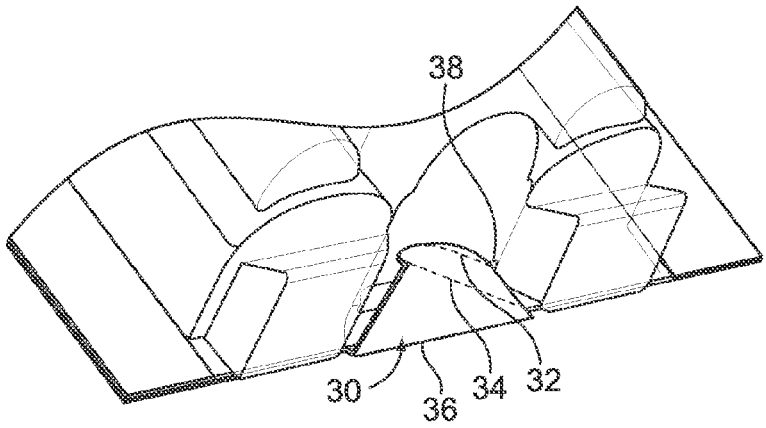
FIGS. 3 and 4 are fragments of the FIG. 2 illustrating the manner in which a locking tab is inserted into a locking slot so that the display package is permanently locked in by means of engaging the backboard and the product cradle with one another.
Figure 4:
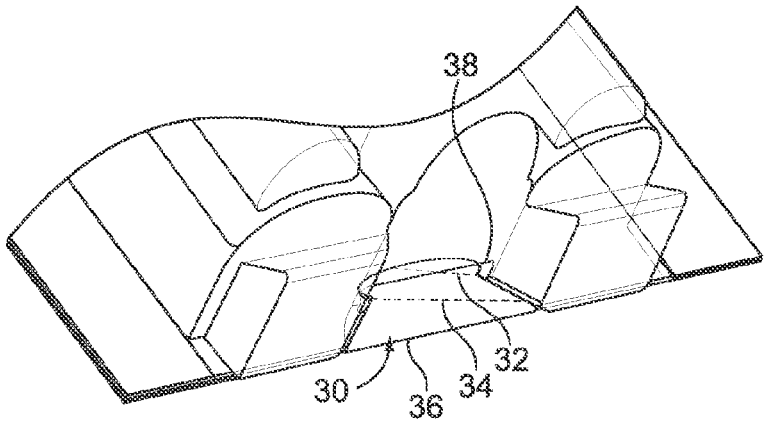
Figure 6:
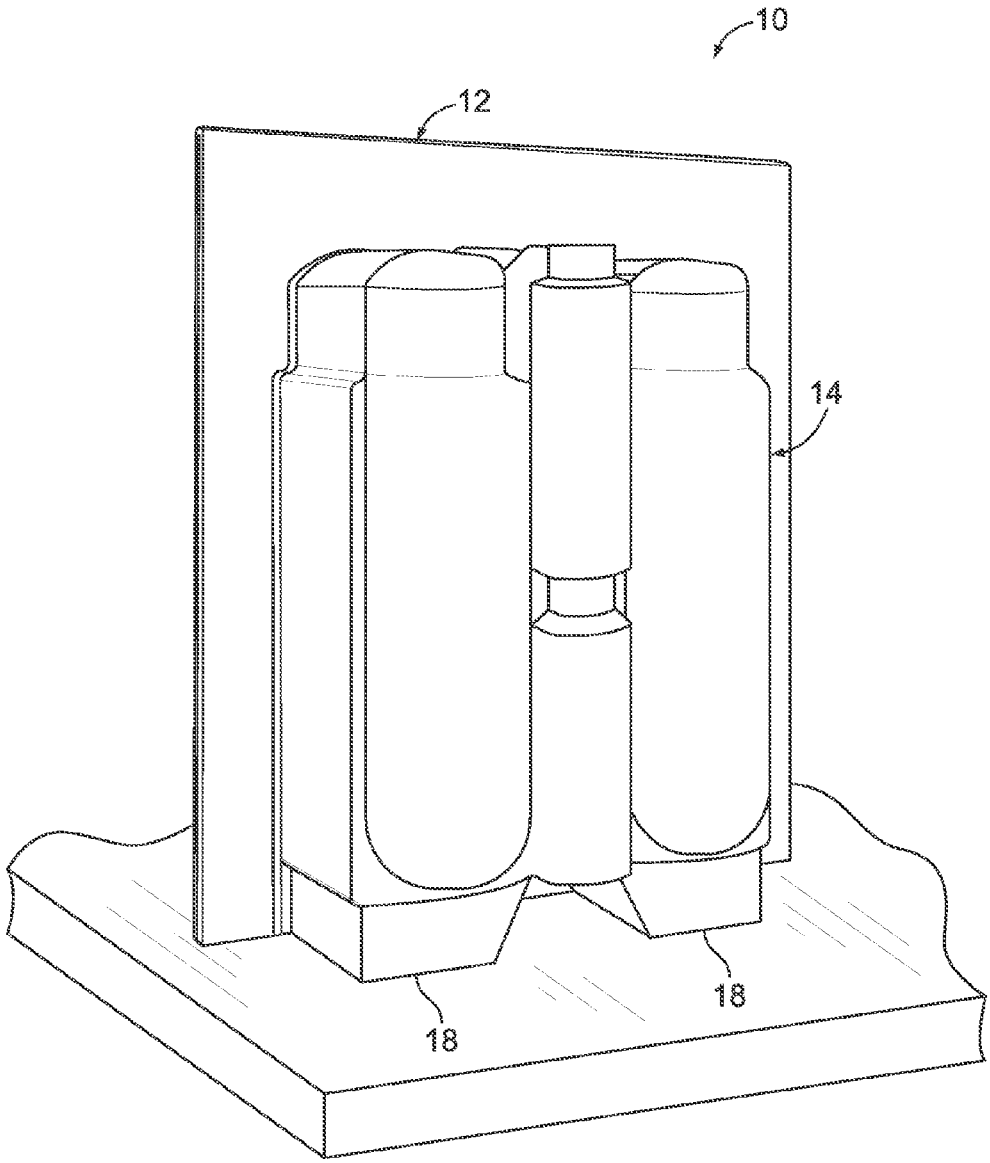
FIG. 6 illustrates the display package in FIG. 2 in self-standing position.

FIGS. 3 and 4 are fragments of the FIG. 2 illustrating the manner in which a locking tab is inserted into a locking slot so that the display package is permanently locked in by means of engaging the backboard and the product cradle with one another. Once the respective front and back faces 21, 22 of the blank 12 (FIG. 7) is glued, the assembly of the display package 10 is simple and requires no special equipment, gluing or jigs. The product cradle or vacform 14 is positioned face down, the article or product 16 is then placed into the interior space or molded space 19. The backboard or display card 12 is then oriented so that the back of it is facing up. Next, the backboard or display card 12 is slipped over the top and side flanges of the product cradle or vacform 14. The flanges 20 will slide up into the backboard, trapped between the front and the back panels of the backboard. The sliding will then stop when the product pocket comes in contact with the top of the opening of the front face of the backboard. The display package 10 is then turned over so the back face 22 is now facing down. Then the locking tab 30 is folded up ward toward the product 16 along the fold line 36 and simultaneously folded downward along respective angled fold lines 32, 34. The locking tab 30 is then inserted into the die cut slot 38 in the interior space below the product 16. The locking tab 30 slips behind the product, which aids in the securing of the locking tab in place. The display package 10 is now complete and can be stood up vertically resting on its legs 18 and bottom of the backboard and placed in trays or table or cartons for shipment as depicted in FIG. 6.

Figure 5:
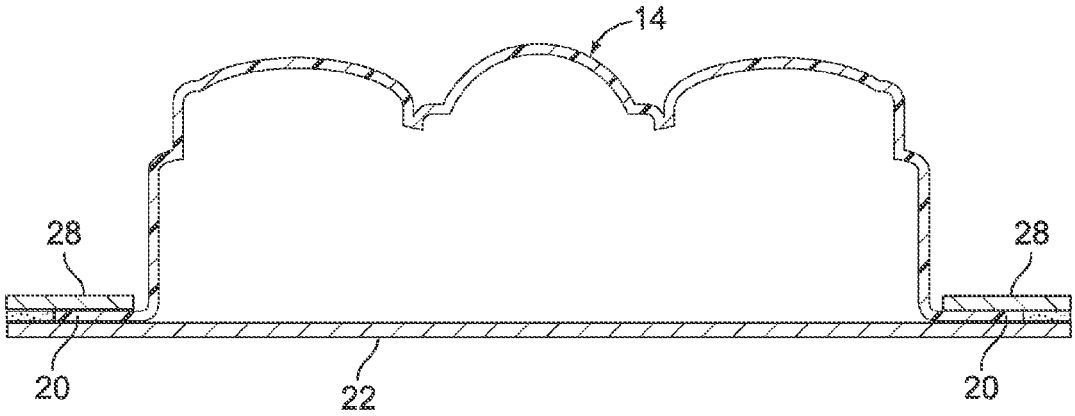
FIG. 5 is a sectional view of FIG. 2 taken along line 5-5, illustrating the detail of engagement of the product cradle and the backboard with one another.
Figure 7:
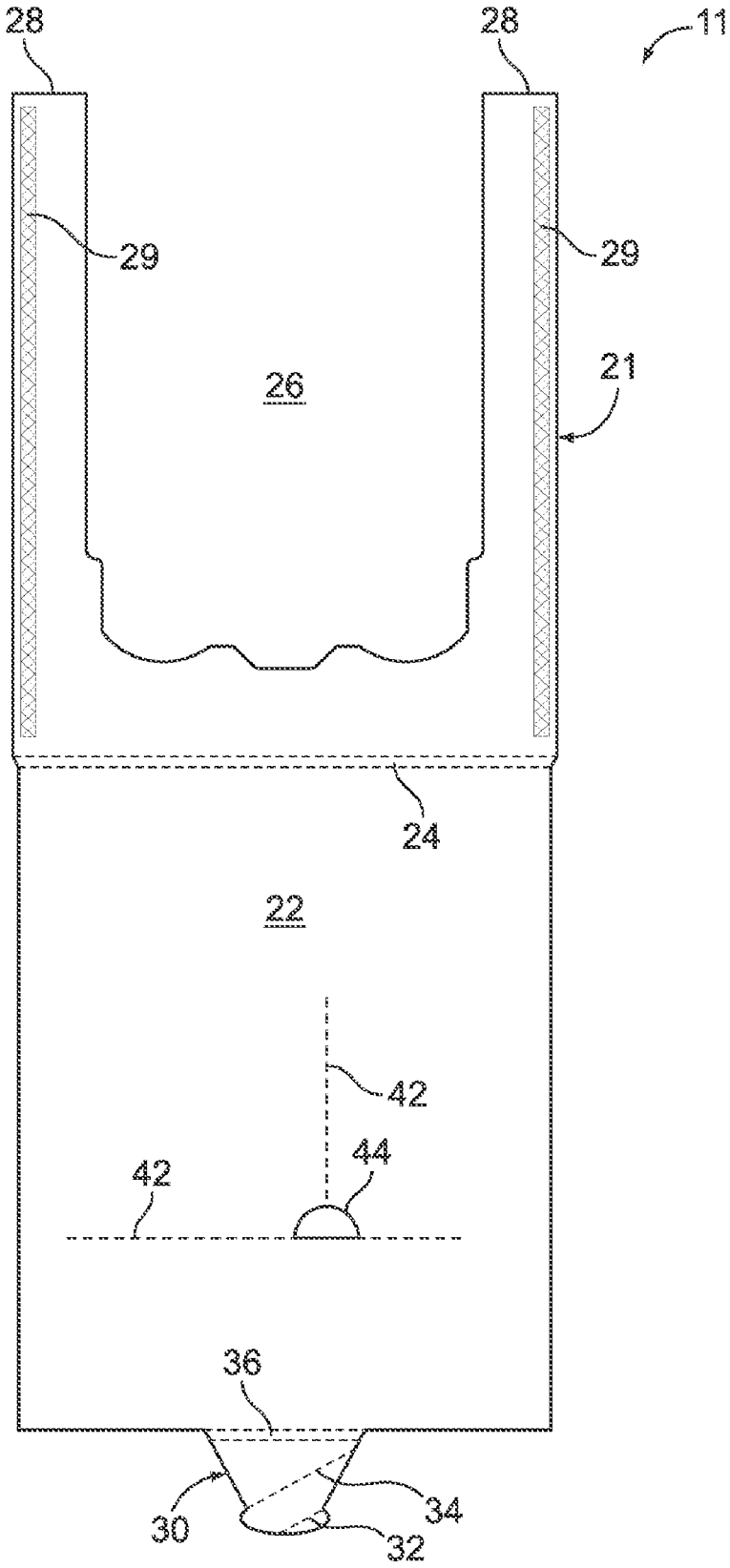
FIG. 7 is a blank used to construct the backboard shown in FIG. 1.

FIG. 7 is a blank 11 used to construct the backboard or display card 12 shown in FIG. 1. The display card or backboard 12 is divided into a front face 21 and a back face 22 by means of a fold line or score line 24. The backboard 12 is made of corrugated cardboard material and is folded generally in half along the fold line 24. The back face 22 includes a generally T-shaped perforated line 42 and a figure access hole 44 formed therein to permit a user to gain access to the products contained in the interior space 19. The back face 22 is rectangular in shape that generally corresponds to the outside perimeter of the vacform 14 when assembled. The front face 21 includes a generally U-shaped cut out 26 formed therein that corresponds to the shape of the molded interior space of the vacform 14 when assembled. The front face 21 also includes two prongs 28 that are adhesively attached to the respective sides of the back face 22 to construct the display card or backboard 12 before final assembly. The two prongs 28 are defined by the U-shaped cut out 26 formed in the front face 21. In the embodiment shown in FIG. 4, the glue area 29 is used to attach the front face 21 to the side edge of the back face 22. It should be noted that the attachment of the two prong 28 to the side edges of the back face 22 forms pockets or grooves 27 therein so that the flange 20 is sandwiched there between as shown in FIG. 5. When assembling the display package 10, the display card or backboard 12 is frictionally engaged with the flange 20 of the product cradle or vacform 14 to securely enclose the interior space 19. The blank 11 is machine glued with a contact adhesive that partially solidifies, without losing any adhesion, before the front and back faces 21, 22 are glued together. The solidified nature of the glue forms a thickness that will be maintained after the front and back faces 21, 22 are together. This thickness is defined by the grooves 27 holds the front and back faces 22, 28 apart making it easy to slide the product cradle flanges 20 between the front and back faces. This contributes to the ease of assembly for packing the product.

As noted above, the back face 22 includes an integrally attached locking tab 30 that extends outwardly from the mid section of lateral edge of the back face 22 and defined by first fold line 36. The locking tab 30 includes two generally angled second and third fold lines 32, 34, respectively. The locking tab 30 is folded along the first fold line 36 and then simultaneously folded downwardly along the second and third angled fold lines 32, 34 and finally inserted on its free end portion into a die cut slot 38 of the product cradle or vacform 14. The die cut slot 38 lies between the legs 18 and is formed within the product cradle or vacform 14. The location of the slot 38 along with the location of the two angled second and third old lines 32, 34 ensure a permanent lock of the display package 10 and making disengagement of the locking tab 30, especially by a user uninformed about the structure, nearly impossible. This greatly improves security, making the chances of taking the smaller product from the display package 10 and pilfering much more difficult than from the less secure packages currently available in retail stores. The display package 10 has an advantage of being larger than its product contained therein so that it deters the display package from being shoplifted.

To remove the product from the display package 10, a user uses a T-shaped perforation 42 with a semi-circular die cut finger access hole 44 large enough to allow a finger into the interior space 19 of the display package 10. The T-shaped perforation 42 is located on the back face 22 of the backboard 11. The user can then pull up on the corrugated backboard 12 and tear the material away to expose the product and remove it. This is somewhat difficult to do quickly which helps to deter pilferage. Additionally, it would be difficult to do at a retail store inconspicuously.

In sum, the present invention is related to a display package comprising a product cradle having an interior space to receive at least one article. The product cradle further includes a peripheral flange extends outwardly from a perimeter of the interior space and a locking slot along the perimeter of the interior space. A backboard comprises a locking tab configured to be inserted into the locking slot to securely enclose the display package. The backboard includes a front face and a back face defined by a fold line in which the front face comprises a U-shaped cut out and two prongs. The back face comprises a generally T-shaped perforations and a finger access hole formed therein. The backboard includes a plurality of grooves formed by adhesively attaching the front and back faces to one another and wherein the plurality of grooves receive the peripheral flange of the product cradle. The product cradle includes two substantially similar self-standing legs integrally formed within the product cradle and each of the self-standing legs configured on opposed side of the locking slot.

Another aspect of the present invention is related to a theft deterrent display package for at least one article comprises a product cradle having an interior space with a perimeter. A peripheral flange extends outwardly from the perimeter of the interior space. A locking slot is configured along the perimeter of the interior space. At least one self-standing leg extends downwardly from the interior space upon which the display package stands alone. A backboard is defined by a front face and a back face. A locking tab comprises a free end extends outwardly from one edge of the back face. The locking tab includes two angled fold lines used in assisting the free end of the locking tab to be inserted into the locking slot to securely enclose the display package. The backboard includes a contact adhesive with a thickness that secures the front and back faces to one another and forms the plurality of grooves between the front and back faces which have a width equal to the thickness of the contact adhesive.

Numerous modifications and variations on the present invention are possible in light of the above teachings. It is, therefore, to be understood that within the scope of the accompanying claims, the invention may be practiced otherwise than as specifically described herein.

It should be understood that product cradle or vacform or blister as used herein may be used interchangeably so long as the function thereof is not destroyed. In addition, backboard or display card as used herein may be used interchangeably so long as the function thereof is not destroyed.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A display package comprising:

a product cradle having an interior space to receive at least one article, the product cradle further having a peripheral flange extending outwardly from a perimeter of the interior space, and a locking slot along the perimeter of the interior space; and a backboard having a locking tab configured to be inserted into the locking slot to securely enclose the display package and wherein the backboard includes a front face and a back face defined by a fold line, wherein the front face comprises a U-shaped cut out and two prongs and wherein the back face comprises a generally T-shaped perforations and a finger access hole formed therein.

2. The display package of claim 1 wherein the product cradle further comprises at least one self-standing leg extending downwardly from the interior space upon which the display package stands alone.

3. The display package of claim 2 wherein the at least one leg includes two substantially similar self-standing legs integrally formed within the product cradle and each of the self-standing legs configured on opposed side of the locking slot.

4. The display package of claim 1 wherein the backboard includes a plurality of grooves formed by adhesively attaching the front and back faces to one another and wherein the plurality of grooves receive the peripheral flange of the product cradle.

5. The display package of claim 1 wherein the locking tab includes two angled fold lines used in assisting a free end of the locking tab to be inserted into the locking slot and wherein the locking tab extends from the lateral edge of the back face.

6. The display package of claim 1 wherein the product cradle is a blister made of clear plastic.

7. A display package contains at least one product comprising:

a product cradle having an interior space with a perimeter, a peripheral flange extending outwardly from the perimeter of the interior space, a locking slot configured along the perimeter of the interior space, and at least one self-standing leg extending downwardly from the interior space upon which the display package stands alone; and a backboard being defined by a front face and a back face wherein the front face and the back face are defined by a fold line, wherein the front face comprises a U-shaped cut out and two prongs and wherein the back face comprises a generally T-shaped perforations and a finger access hole formed therein, a locking tab extends outwardly from one edge of the back face, wherein the locking tab configured to be inserted into the locking slot to securely enclose the display package.

8. The display package of claim 7 wherein the at least one leg includes two substantially similar self-standing legs upon which the display package can stand alone.

9. The display package of claim 7 wherein the backboard includes a plurality of grooves between the front and back faces for engaging the peripheral flange of the product cradle.

10. The display package of claim 7 wherein the backboard includes a contact adhesive with a thickness that secures the front and back faces to one another and forms the plurality of grooves between the front and back faces which have a width equal to the thickness of the contact adhesive.

11. The display package of claim 7 wherein the locking tab includes two angled fold lines and a free end for engaging the locking slot of the product cradle.

12. The display package of claim 7 is a blister package.

13. A display package contains at least one product comprising:

a product cradle having an interior space with a perimeter, a peripheral flange extending outwardly from the perimeter of the interior space, a locking slot configured along the perimeter of the interior space, and at least one self-standing leg extending downwardly from the interior space upon which the display package stands alone; and a backboard being defined by a front face and a back face wherein the front face and a back face are defined by a fold line, wherein the front face comprises a U-shaped cut out and two prongs and wherein the back face comprises a generally T-shaped perforations and a finger access hole formed therein, a locking tab having a free end extends outwardly from one edge of the back face, wherein the locking tab includes two angled fold lines used in assisting the free end of the locking tab to be inserted into the locking slot to securely enclose the display package.

* * * * *